US006494355B2

(12) United States Patent
Adachi et al.

(10) Patent No.: US 6,494,355 B2
(45) Date of Patent: Dec. 17, 2002

(54) STRUCTURE FOR GUIDING NAIL TO NOSE PORTION OF NAILING MACHINE

(75) Inventors: Michiaki Adachi, Tokyo (JP); Toru Uchiyama, Tokyo (JP)

(73) Assignee: Max Co., Ltd., Tokyo (JP)

( * ) Notice: Subject to any disclaimer, the term of this patent is extended or adjusted under 35 U.S.C. 154(b) by 13 days.

(21) Appl. No.: 09/834,914

(22) Filed: Apr. 16, 2001

(65) Prior Publication Data

US 2001/0030218 A1 Oct. 18, 2001

(30) Foreign Application Priority Data

Apr. 17, 2000 (JP) ..... 2000-115724

(51) Int. Cl.[7] ..... B25C 1/04
(52) U.S. Cl. ..... 227/119; 227/120
(58) Field of Search ..... 227/119, 120, 227/136, 109, 130

(56) References Cited

U.S. PATENT DOCUMENTS 4,903,880 A * 2/1990 Austin et al. ..... 227/120
5,180,091 A * 1/1993 Ota ..... 227/130
5,437,404 A * 8/1995 Shlolnikov ..... 227/119
5,842,625 A * 12/1998 Kimura ..... 227/120
5,897,046 A * 4/1999 Oehri et al. ..... 227/119
6,149,046 A * 11/2000 Ho et al. ..... 227/120
6,209,770 B1 * 4/2001 Perra ..... 227/120

* cited by examiner

*Primary Examiner*—Scott A. Smith
(74) *Attorney, Agent, or Firm*—Morgan, Lewis & Bockius LLP

(57) ABSTRACT

In the side portion of a nose portion disposed in the leading end portion of a nailing machine main body, a guide port is formed for guiding a nail supplied from a magazine. The opening end of a nail passage formed in the magazine is butted against the opening end of the guide port, and the nails in the nail passage can be sequentially pushed out by a pusher from the guide port to the nose portion. The inner wall of the guide port adjacent to the magazine is extended and inserted into the nail passage of the magazine, and the end portion of the extended inner wall is connected and continuous with the wall surface of the nail passage.

6 Claims, 3 Drawing Sheets

STRUCTURE FOR GUIDING NAIL TO NOSE PORTION OF NAILING MACHINE

BACKGROUND OF THE INVENTION

1. Field of the Invention

The present invention relates to a structure for guiding nails from the magazine of a nailing machine to the nose portion of the nailing machine. Further, the present invention relates to a nailing machine including the above structure.

2. Description of the Related Art

Generally, nails are supplied from the magazine of a nailing machine to the nose portion of the nailing machine; and, in the magazine, there is formed a nail passage and the leading end of the nail passage is butted against the nose portion and is formed in such a manner as shown in FIG. 4.

That is, in the side portion of the nose portion 2, there is formed a guide port 8 which is used to guide a nail supplied from the magazine 3, and the opening end of the nail passage 6 of the magazine 3 is butted against the opening end of the guide port 8, whereby a nail 5 stored within the nail passage 6 can be pushed out sequentially by a pusher 7 from the guide port 8 to a driving port 2*a* of the nose portion 2. Further, for smooth guidance of the nail 5 to the guide port 8, the width of the guide port 8 is set larger than the width of the nail passage 6, and guide portions 14 and 15 for guiding the nail 5 are formed in the opening end of the guide port 8. The guide portions 14 and 15 are respectively formed as inclined surfaces, and recessed portions 11 are respectively formed between the nail passage 6 and guide portions 14, 15.

However, according to the above-mentioned structure, normally, when the last nail is pushed by the pusher 7, the nail, with a portion thereof pressed against the corner portion of the pusher 7, is guided to the guide portion 14 of the recessed portion 11 at the opening end of the guide port 8 and is fed into the guide port 8. However, if the butting portion 16 of the nail to be butted against the inclined guide portion 14 and the pressing portion 17 of the nail to be pressed by the pusher 7 are situated almost on the opposite side to each other, the pressure by the pusher 7 acts on the nail 5 more strongly in the direction to press the nail 5 against the guide portion 14 than in the direction to feed the nail 5 into the nose portion 2. Therefore, there is a fear that the nail 5 may be caught by the guide portion 14 because the nail 5 is put between the guide portion 14 and the pusher 7 at the butting portion 16 and the pressing portion 17, respectively. In this case, the nail 5 cannot be fed into the driving port 2*a;* therefore, there is a fear that idle driving of nail may be caused by poor nail feeding.

SUMMARY OF THE INVENTION

The present invention aims at eliminating the above drawbacks found in the conventional structure. Accordingly, it is a first object of the invention to provide a structure for guiding nails to the nose portion of a nailing machine from a magazine thereof, which can guide the nails smoothly without the last one of the nails being caught in the opening end of the nose portion. Further, a second object of the invention is to provide a nailing machine including such a structure for guiding nails to the nose portion.

In order to attain the above objects, there is provided the following guiding structure for a nail in a nailing machine. The nailing machine includes a nailing machine main body, a magazine having a nail passage for supplying a nail, a pusher for pushing the nail, a nose portion disposed in a leading end portion of the nailing machine main body and having a driving port for driving the nail, and a guide port disposed on a side portion of the nose portion for guiding a nail to the driving port of the nose portion. The nail passage of the magazine is continuous with the guide port, and the nail in the nail passage is pushed from the guide port to the driving port of the nose portion by the pusher. The guiding structure includes an extended inner wall disposed to the guide port and extending to the nail passage of the magazine, wherein an end portion of the extended inner wail is continuous with a wall surface of the nail passage of the magazine.

DETAILED DESCRIPTION OF THE PREFERRED EMBODIMENTS

Figure 1:
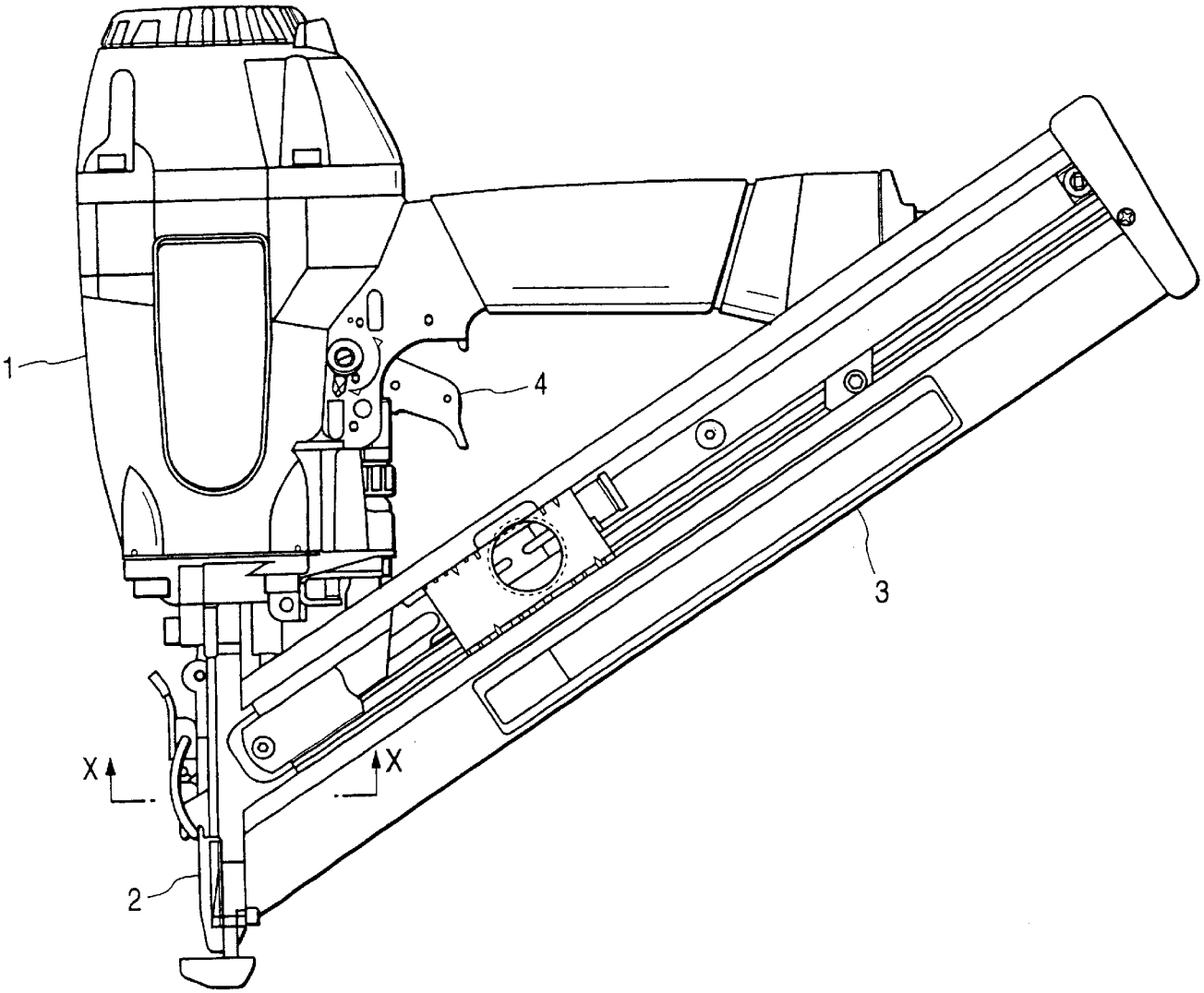
FIG. 1 is a side view of a nailing machine including a nail guide structure according to the invention.
Figure 2:
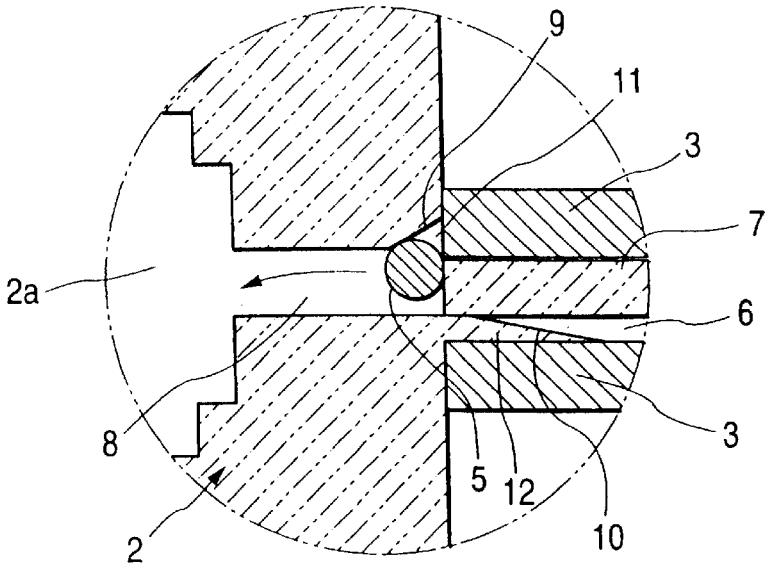
FIG. 2 is an enlarged section view taken along the line X—X shown in FIG. 1, showing a first embodiment of a nail guide structure according to the invention.

FIG. 1 shows a nailing machine, and FIG. 2 is an enlarged section view of the nailing machine taken along the line X—X shown in FIG. 1, showing a first embodiment of a nail guide structure according to the invention. In the drawings, reference character 1 designates a nailing machine main body of a pneumatic drive type, 2 designates a nose portion of the nailing machine, and 3 designates a magazine of the nailing machine. In the interior portion of the nailing machine main body 1, a hammering mechanism (not shown) utilizing compressed air is disposed. In operation, the hammering mechanism is operated by pulling a trigger lever 4 so as to drive a driver, so that nails supplied to the nose portion 2 from the magazine 3 can be driven out of the nose portion 2 by the driver.

In the magazine 3, there are stored a group of connected nails consisting of a plurality of nails connected together through connecting members; and, reference character 5 designates the last nail of the connected nails. The connected nails are respectively pushed toward the nose portion 2 by a pusher 7 which is disposed within a nail passage 6 formed in the magazine 3.

In order to supply the nails from the magazine 3 to a driving port 2*a* of the nose portion 2, a nail guide port 8 is formed on the side portion of the nose portion 2 on the side of the magazine 3, while an opening end of the nail passage 6 of the magazine 3 is butted against an opening end of the guide port 8.

The guide port 8 of the nose portion 2 is formed such that the width thereof is larger than the width of the nail passage 6. This is because, if the width of the guide port 8 of the nose portion 2 is smaller than the width of the nail passage 6, there is a fear that the nail may be butted against the corner portion of the guide port 8 and thus may be caught by the guide port 8. Further, this is because, if the width of the guide port 8 and the width of the nail passage 6 are equal to each other, the magazine 3 may be shifted in position due to errors to thereby raise the same fear.

Incidentally, in the opening end portion of the guide port 8 on the side of magazine 3, a first guide portion 9 and a second guide portion 10 are formed and are respectively used to guide the nails to the nose portion 2. These two guide portions 9 and 10 are formed such that they are shifted in position in the nail feeding direction.

More specifically, the first guide portion 9 is formed in the nose portion 2, and a recessed portion 11 is formed between the first guide portion 9 and the end portion of the nail passage 6.

Figure 4:
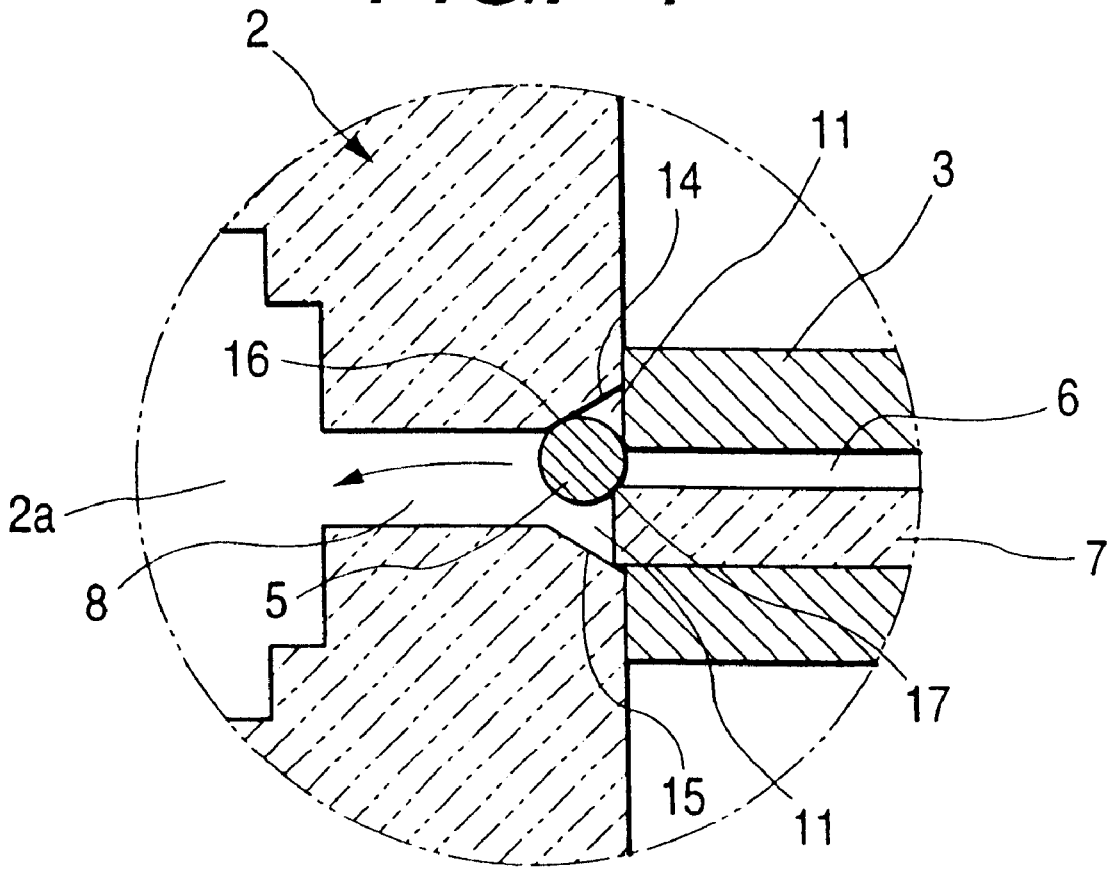
FIG. 4 PRIOR ART
FIG. 4 is a section view of a conventional nail guide structure.

On the other hand, the second guide portion 10 is formed in the nail passage 6 of the magazine 3. That is, since the width of the nail passage 6 is set slightly larger than the width of the pusher 7, such a gap as shown in FIG. 4 is produced between the pusher 7 and nail passage 6. By making use of this gap, an extended wall portion 12 having a slightly smaller thickness than the gap is formed on the opening end side of the guide port 8 of the nose portion 2 in such a manner that it is integral with the gap; and, the second guide portion 10 is formed in the end portion of the extended wall portion 12. The extended wall portion 12 is inserted into the nail passage 6 and is mounted on the inner wall of the nail passage 6 in such a manner that it is contacted with an inner wall of the nail passage 6. Due to this, the wall surface of the guide port 8 of the nose portion 2 is continuous with the wall surface of the nail passage 6.

According to the above-described structure, when the connected nails are consumed sequentially and the last nail 5 is pushed by the pusher 7 and is guided from the nail passage 6 to the guide port 8 of the nose portion 2, firstly, the nail 5 is guided by the second guide portion 10 and is sent along the extended wall portion 12. Next, the nail 5 is guided by the first guide portion 9 and is sent to the guide port 8. In this manner, the first and second guide portions 9 and 10 are formed such that they are separated from each other in two stages, whereby the nail 5 is firstly guided by the second guide portion 10 and, after then, at the opening end of the guide port 8, the nail 5 is guided by the first guide portion 9 and is thus sent to the guide port 8. Since the second guide portion 10 is formed by the extended wall portion 12 of the nose portion 2, the nail passage 6 is narrowed by a thickness equivalent to a thickness of the extended wall portion 12 at each portion thereof. The pusher 7 can push the rear end portion of the nail 5 without swaying from side to side. Even if, as shown in FIG. 2, the obliquely front portion of the nail 5 enters the recessed portion 11 and is butted against the first guide portion 9, the nail 5 is pushed from just behind by the pusher 7, the pressing force of the pusher 7 acts on the nail 5 more strongly in the direction to send the nail 5 to the nose portion 2 than in the direction to press the nail 5 against the first guide portion 9. Therefore, the nail 5 is guided by the first guide portion 9, is sent out to the guide port 8, and is finally supplied to the driving port 2*a* of the nose portion 2. Thus, the connected nails including the last one thereof can be supplied smoothly to the driving port 2*a* of the nose portion 2 in such a manner that even the last nail 5 is prevented from being caught by the first guide portion 9.

Figure 3:
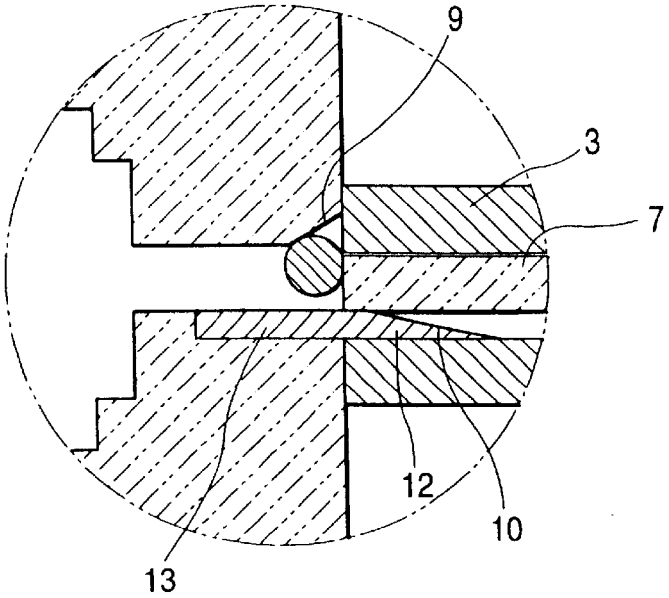
FIG. 3 is a section view of a second embodiment of a nail guide structure according to the invention.

It is not always necessary that the extended wall portion 12 is formed integrally with the nose portion 2. That is, as shown in FIG. 3, a separate member 13 maybe fitted between the nose portion 2 and the nail passage 6.

While only certain embodiments of the invention have been specifically described herein, it will be apparent that numerous modifications may be made thereto without departing from the spirit and scope of the invention.

What is claimed is:

1. A guiding structure for a nail in a nailing machine, the nailing machine including a nailing machine main body, a magazine having a nail passage for supplying a nail, a pusher for pushing the nail, a nose portion disposed in a leading end portion of the nailing machine main body and having a driving port for driving the nail, and a guide port disposed on a side portion of the nose portion for guiding a nail to the driving port of the nose portion, wherein the nail passage of the magazine is continuous with the guide port, and wherein the nail in the nail passage is pushed from the guide port to the driving port of the nose portion by the pusher, the guiding structure comprising:

an extended inner wall disposed to the guide port and extending into the nail passage of the magazine, wherein an end portion of the extended inner wall is continuous with a wall surface of the nail passage of the magazine.

2. The guiding structure according to claim 1, wherein the extended inner wall is formed integrally with the nose portion.

3. The guiding structure according to claim 1, wherein the extended inner wall is a separate member fitted between the nose portion and the nail passage.

4. A nailing machine comprising:

a nailing machine main body;

a magazine having a nail passage for supplying a nail;

a pusher for pushing the nail;

a nose portion disposed in a leading end portion of the nailing machine main body and having a driving port for driving the nail; and a guide port disposed on a side portion of the nose portion for guiding a nail to the driving port of the nose portion, an extended inner wall disposed to the guide port and extending into the nail passage of the magazine, wherein the nail passage of the magazine is continuous with the guide port, and wherein the nail in the nail passage is pushed from the guide port to the driving port of the nose portion by the pusher, and wherein an end portion of the extended inner wall is continuous with a wall surface of the nail passage of the magazine.

5. The nailing machine according to claim 4, wherein the extended inner wall is formed integrally with the nose portion.

6. The nailing machine according to claim 4, wherein the extended inner wall is a separate member fitted between the nose portion and the nail passage.

* * * * *